United States Patent [19]

Kampf et al.

[11] 3,938,496

[45] Feb. 17, 1976

[54] FIREPLACE FORCED AIR CIRCULATION MEANS

[75] Inventors: William M. Kampf, Rancho Santa Fe; Denny B. Law, San Marcos, both of Calif.

[73] Assignee: Aquappliances, Inc., San Marcos, Calif.

[22] Filed: Dec. 26, 1974

[21] Appl. No.: 536,566

[52] U.S. Cl. ..... 126/121; 126/202

[51] Int. Cl.[2] ..... F24B 7/00

[58] Field of Search ..... 126/121, 120, 138, 140, 126/164, 165, 202, 203

[56] References Cited

UNITED STATES PATENTS

| | | | |
|---|---|---|---|
| 1,030,002 | 6/1912 | Livingston | 126/164 |
| 1,589,539 | 6/1926 | Marchessault | 126/121 |
| 1,681,606 | 8/1928 | Blanchard | 126/121 |
| 2,161,723 | 6/1939 | Rutland | 126/121 |
| 3,271,914 | 9/1966 | Boyett | 126/120 X |

*Primary Examiner*—William F. O'Dea
*Assistant Examiner*—Harold Joyce
*Attorney, Agent, or Firm*—Duane C. Bowen

[57] ABSTRACT

Forced hot air circulation is provided for a fireplace by a unit that can be "pushed" into place including a bank of lower tubes that are positioned in the firebox and provide a grate and including an outer housing lapping the margins of the firebox opening and having a lower manifold that feeds the forward ends of the lower tubes and having an upper register that connects to the forward ends of a bank of upper tubes. The lower tubes bend upwardly and are connected by a manifold to the upper tubes. The upper tubes are smaller and more numerous than the lower tubes and are arranged so that gas rising past the upper tubes must follow tortuous paths. Blowers are connected to the lower manifold.

7 Claims, 4 Drawing Figures

10
12
14
16
18
20
22
24
30
32
34
36
37
40
50
52
54
56
58
60
62
63
64
70
72
80
82
90
91
92

10
12
16
18
20
22
24
30
32
34
35
36
37
40
62
63
64
91

10
12
14
16
18
20
24
30
32
34
35
37
38
40
42
44
46
48
50
52
56
58
70
72

FIREPLACE FORCED AIR CIRCULATION MEANS

BRIEF SUMMARY OF THE INVENTION AND OBJECTIVES

Our invention relates to forced air circulation for fireplaces and, more specifically, to a "push in" unit having inner heat-exchanging tubes in the firebox and having an outer housing, outside the firebox, serving other functions.

Natural convection and forced air circulation means have been proposed before for fireplaces but variously lack features, found in our unit, we think to be desirable for the general potential market for such apparatus, including:

a. The unit should be capable of being installed in most fireplaces of the types found in residences today. In other words, the unit should be capable of being "pushed in" conventional fireplaces and should not require special construction or modification of existing or future fireplaces in order to be used. Installation should be about as simple as suggested by the "push in" descriptive term.

b. Only the heat-exchanging tubes should be positioned in the firebox. Heat-sensitive parts, such as blowers, wiring, etc., should be positioned outside of the firebox in areas of more moderate temperatures. Neither is there need to crowd the firebox space with other than heat-exchanging members, i.e., the general housing and closure can be on the hearth outside the firebox, as well as means for entry air manifolding and the exit air register. The concept of having air circulation means for a fireplace with part of the assembly on the hearth in front of the firebox appears to be new with us. An integral associated new concept is that it is possible to have a housing on the hearth outside of the firebox constructed so as to have minimum interference with normal viewing of a fire in the firebox. The former concept without the latter concept might have little if any appeal.

c. There is a large, usually unrealized potential for home heating from the surprising amount of heat available from a fire in a fireplace, provided a widely adaptable and economical forced air circulation unit can be provided.

The objectives of our invention include features (a), (b) and (c) above, briefly to provide a "push in" unit capable of ready use with conventional fireplaces, to dispose all structure outside of the firebox, on the hearth, except for heat-exchanging tubing, and to devise an economical, widely adaptable unit. Further objectives of our invention include to provide such a unit that will take advantage of substantially the full potential in heating a home of the heat available from a fireplace, to devise such apparatus of economical but durable construction, and to provide a design of attractive appearance that will permit viewing of the fireplace fire (one of the reasons for having a fireplace) much the same as with a fireplace without air circulation apparatus.

Our invention will be best understood, together with additional objectives and advantages thereof, from the following description, read with reference to the drawings, in which.

Figure 3:
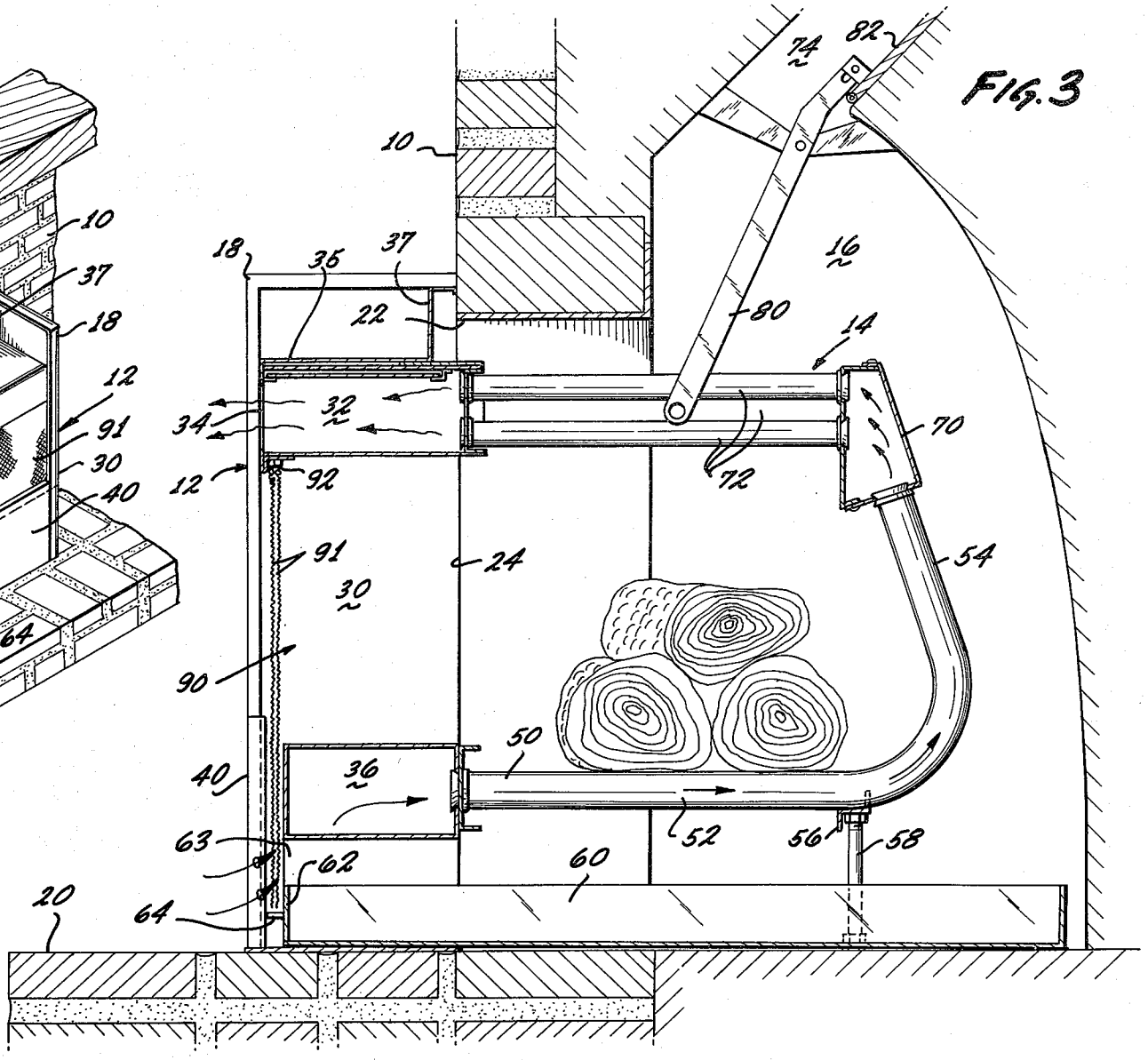
FIG. 3 is a side elevational view, partly in section, taken generally on lines 3 — 3 of FIG. 2.
Figure 1:
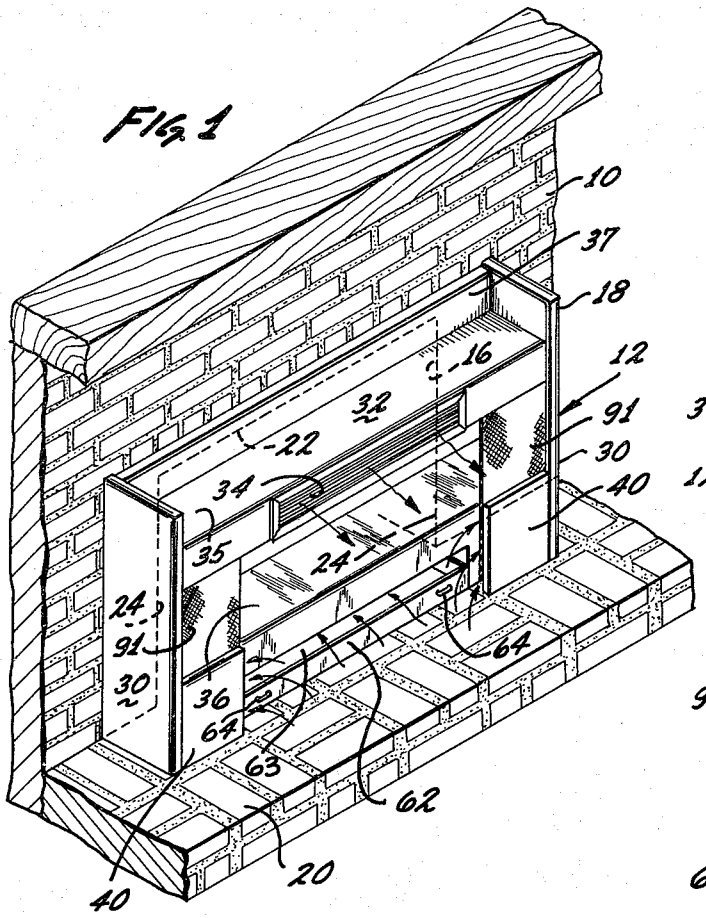
FIG. 1 is a perspective view of a specific embodiment of our forced air circulation means, shown installed in a conventional fireplace.

The fireplace 10 shown in the drawing is intended to be depicted as being of conventional design. It appears that the majority of fireplaces installed for a number of years (i.e., at least the post-World War II period) have been rather standardized to a limited range of proportions and dimensions, so that one-sized unit may be able to fit most of them, in the manner we have constructed ours. Out unit may fit many fireplaces of earlier times. Other proportions and larger sizes of fireplaces may be constructed, particularly in expensive homes, which one basic unit of our design will not fit. One factor that has tended to standardize fireplaces is the use of prefabricated steel fireboxes, etc., about which or within which masonry can be installed. One unit of our design can adapt to a certain range of firebox sizes. Of course we can provide more than one sized unit but it is advantageous to minimize numbers of sizes because of manufacturing and distribution considerations. Some prior air circulation designs for fireplaces have required special construction of the fireplaces, which, of course, limits application to new units, whereas our intention is to be able to slide the unit into place in conventional fireplaces, such as the one depicted.

Our fireplace forced air circulation unit 12 has a heat-exchanger section 14 that is disposed in the fireplace firebox 16 and an outer housing 18 that rests on the hearth 20 outside of firebox 16. Housing 18 is wider and taller than firebox 16 and laps the margins of the facing of the fireplace including the upper margin at 22 and the side margins at 24. Note that unit 12 is adaptable to any fireplace which does not exceed the housing dimensions in width and height of the outer dimensions of its firebox and which has a firebox at least as large in depth, height and width as heat-exchange section 14.

This means that the firebox can be substantially deeper, higher or wider than heat-exchanger section 14 (as long as it is not less deep, high or wide) and as long as it is not higher or wider than housing 18. It is not our intention that heat-exchanger section 14 exactly fit the firebox 16 but rather that it not be too large for the common range of sizes of fireboxes. Exact fitting is not needed for the heat-exchanging function.

Housing 18 has sidewalls 30 and an upper register 32 supported therebetween faced with a grill 34. Housing 18 is shown with a shelf 35 and a backwall 37 above register 32 but housing 18 instead could be constructed without this "step", with register section 32 higher and flush with the tops of sidewalls 30, as that matter relates more to appearance rather than to function. It will be understood that heated air exits from register 32.

Supported between sidewalls 30 is a manifold 36 that feeds room air to heat-exchanger section 14. A pair of electrically powered blowers 38, supported by housing 18 on either side, are directed to feed forced air from the room to manifold 36. Blowers 38 are covered by face plates 40 but are supported by other housing structure, which leaves the space between face plates 40 and blowers 38 open for feeding of air therebetween to the center inlets 42 of blowers 38. Blowers 38 can be of the well-known, economical squirrel-cage type. Preferably two blowers 38 are provided in order to obtain the desired maximum air output while using blowers of a size which fit within the space available in housing 18. One squirrel-cage type blower could be used but this would not provide the air flow we deem desirable unless a larger size is used that would require more housing space than is available in the design depicted and described. Two blowers also feed the tubes connected to manifold 36 more evenly than one would do.

Figure 2:
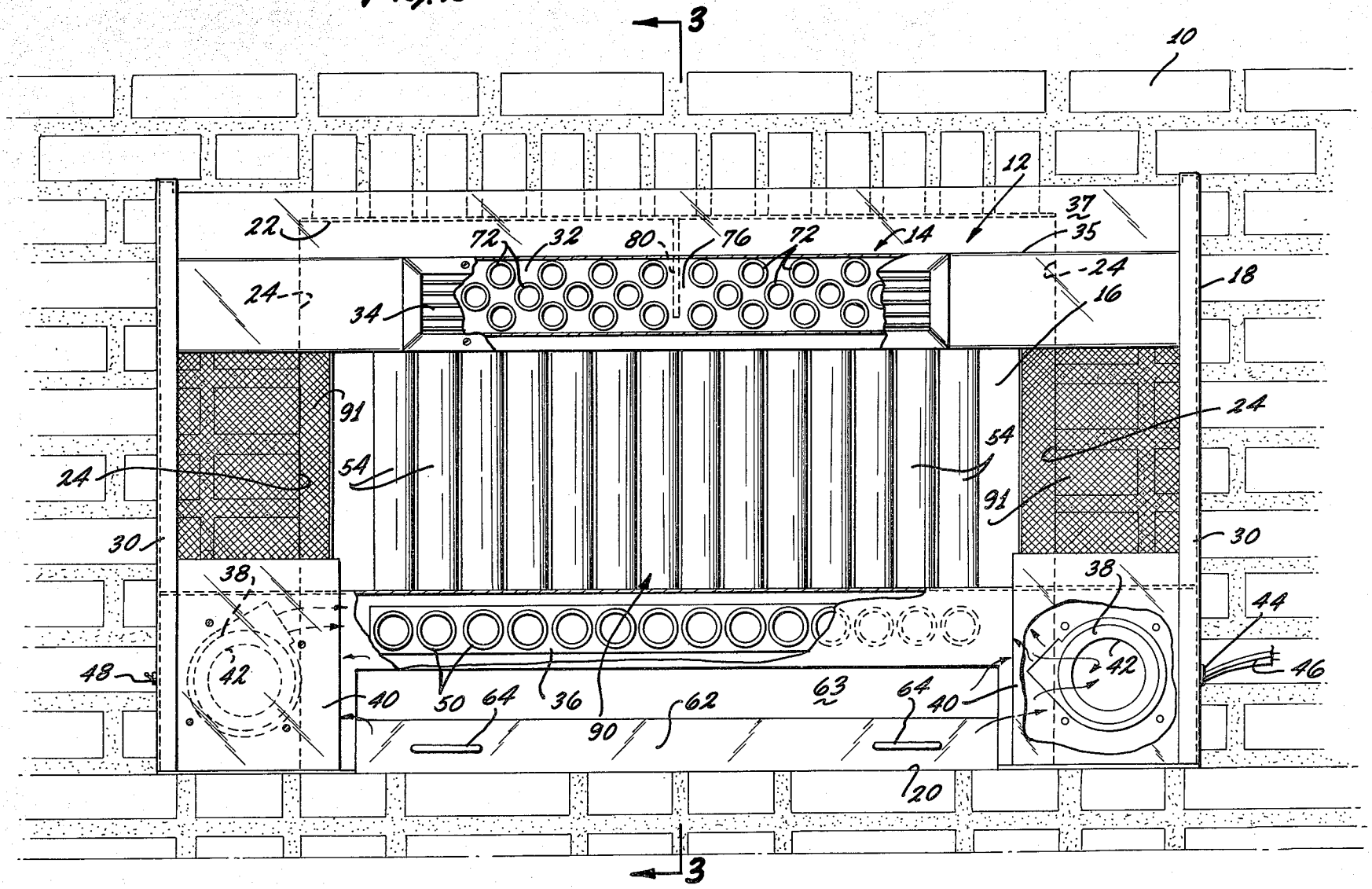
FIG. 2 is a front view, on enlarged scale, with certain parts broken away in order to better reveal some of the structure.

A plug 44 is shown on the right for connection of an electrical cord 46 and a control switch 48 is shown on the left, in FIG. 2. The circuitry will be obvious. Control switch 48 can be a simple "on-off" switch. To vary the air and heating output, however, blowers 38 may have high and low speeds and switch 48 can have three positions: "off", "high speed" and "low speed."

At least one blower is needed in order to take advantage of the heat from a fireplace. Our unit would be operative to direct heated air into a room with merely natural convection air circulation but this would greatly limit air heating and would lead to tubing burnout, particularly in the grating, unless expensive tubing material were used. At the present time of fuel shortage and of increasingly expensive fuels, taking advantage of the heat available from a fireplace for house heating is particularly important. Little of the potential is realized with a conventional fireplace. Maximum practical utilization of the heating potential (with an economical construction) is provided with our unit in which there is forced air and in which heat-exchanging to the forced air stream is accomplished in the firebox by rather direct contact with the burning fuel and coals and with as much contact as is feasible with the heated gases rising from the fire (in addition to radiant heating of the heat-exchanger). If a home has a forced air furnace, the fan from that furnace (whether activated separately or in conjunction with running of the furnace) can help distribute air from register 32 to other parts of the house, and the amount of distribution will be partly influenced by the location of room outlet and return air registers relative to the location of the fireplace.

Turning now to the heat-exchanger section 14, a bank of spaced, juxtaposed tubes 50 are connected at one end to manifold 36, and have a first horizontally disposed grate section 52 defining a grate to support fuel to be burned and have a second upwardly (and somewhat forwardly) directed section 54 that extends to the upper portion of firebox 16.

A transverse member 56 is suitably attached to the rear of tubing section 52 and has adjustable legs 58 on either end supporting the rear end of heat-exchanger 14. It will be observed that heat-exchanger section 14 can be installed by merely sliding it into place in firebox 16 until housing 18 abuts the face of fireplace 10. Wood can be burned on grate 52, as shown, or other material can be burned such as coal or charcoal. Tubes of about 1.50 inch O.D. spaced about 0.50 inch apart are suitable. A fire on such a grate can burn down to a "nub." An ash tray 60 under grate section 52 has a front wall 62 in the plane of the front of manifold 36 and providing a gap at 63 between tray 60 and manifold 36 for added air flow for combustion of fuel on grate 52. Ash tray 60 has handles 64 and is a convenience in disposing of ashes.

The upper ends of the upwardly extending section 54 of tubes 50 are connected together by a manifold 70. Manifold 70 is connected to register 32 by a bank of upper tubes 72. These are preferably smaller and more numerous than tubes 50. As the gaseous products of combustion tend to cone somewhat in passing up to the fireplace flue 74, bank 72, as shown, does not need to be as wide as bank 50. A central gap 76 is left in tubes 72 (i.e., about an inch) for access to handle 80 of damper 82 (or to an extension that may be secured to handle 80 for more convenient, lower access).

Whereas tubes 72 cannot block passage of the gaseous products of combustion from a fire on grate 52, the more "wiping" action of the gases on tubes 72 the better. This is the reason that tubes 72 are arranged in three rows preferably having such density that, when viewed from above, tubes 72 present substantially a complete heat-exchanging medium (without spacing). Actually, of course, the central row of tubes 72 substantially fill the projected space between upper and lower rows, but gases can pass tubes 72 by following tortuous paths.

A preferred size of tubes 72 is about 1⅛ inches O.D. and the spacing of tubes in each row is about 1⅛ inches. This means that in plan view the tubes will appear to be centered at 1⅛ inches (as the middle row fills in the spaces between the tubes of the top and bottom rows).

Figure 4:
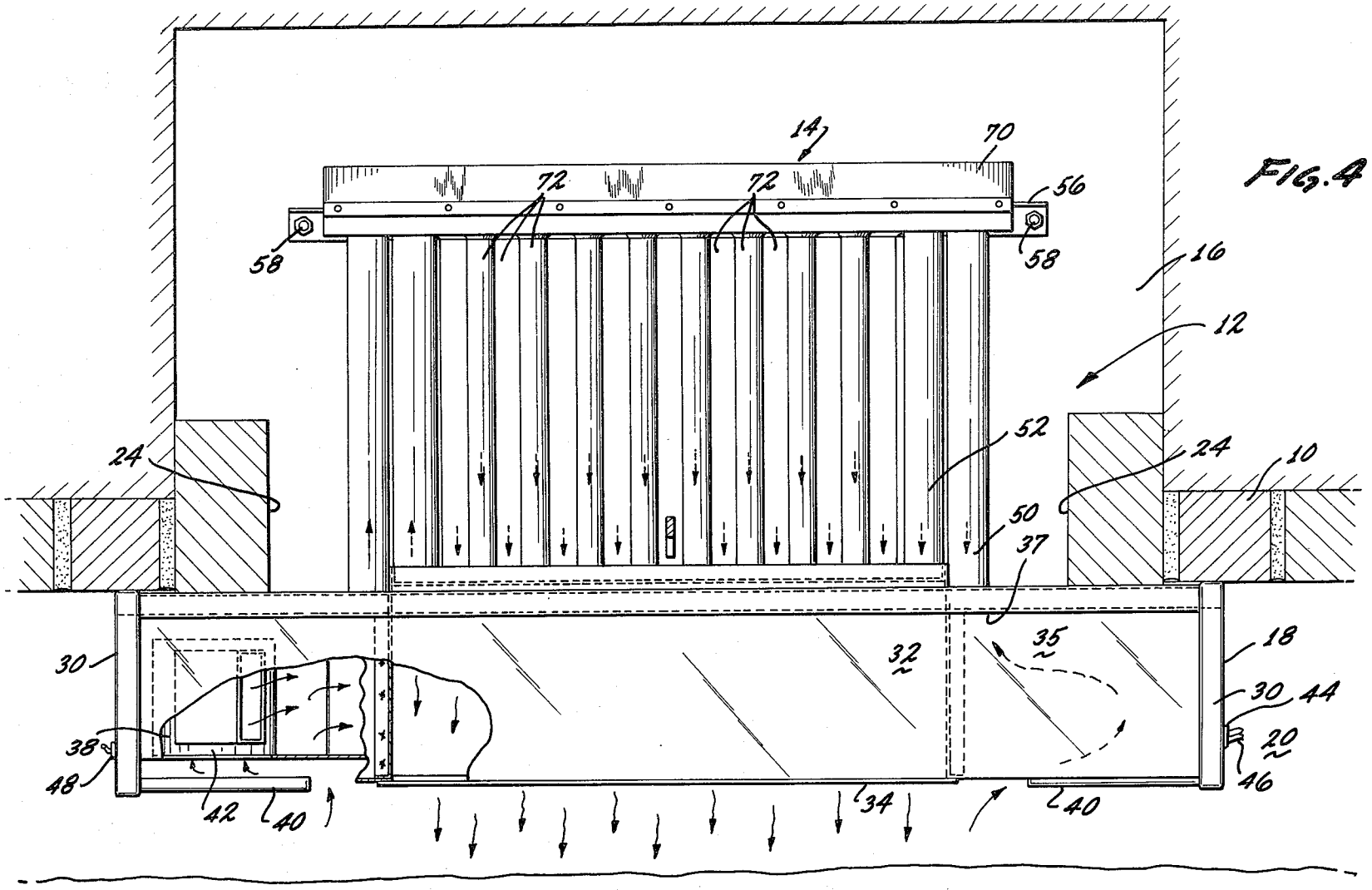
FIG. 4 is a top view with certain parts broken away to better reveal some of the structure.

A fireplace screen 91 is indicated in FIG. 2, together with suitable supports 92. This is not illustrated in detail as the construction can follow conventional draw fireplace screens. It will be noted that screen 91 along with housing members, form a complete spark arresting medium. Access for viewing of a fire in the fireplace, one of the reasons for having a fireplace, is rather comparable to viewing the fire in a fireplace without forced air circulation means, i.e., minimum viewing obstruction is involved consistent with the function of the air circulating unit 12. The open central housing portion 90 extends at least substantially from side to side of firebox 16, and in fact can extend farther, as illustrated. Open portion 90 extends about half of the vertical height of firebox 16, from a level near the grate upwardly. This means that the fire can be seen from viewpoints in an arc horizontally rather comparable to viewing of a conventional fireplace and the fire can be seen from viewpoints in a substantial arc vertically, i.e., in most sitting positions, and in most standing positions except those close to the fireplace. From particularly FIG. 4, it can be seen that the horizontal arc of viewing, in the illustration, of a fire on the grate, is substantially the same as with a conventional fireplace.

The operation of our unit 12 has been explained in the course of the above discussion, but will be briefly reviewed. The unit 12 can be installed merely by sliding or pushing it into most fireplaces. When a fire is lighted on grate 52, blowers 38 are operated to force air through manifold 36, through grate section 52, up section 54, through manifold 70, through tubes 72 and out of register 32. The room air passing through the tubes picks up heat. The tubes are heated by conduction, convection, and radiation. The blowers are positioned in areas that are relatively temperate. The fire can be observed in much the usual manner. The unit 12 utilizes about the maximum amount of heat in a firebox consistent with considerations of economy of manufacture, use in conventional fireplaces, and good fire viewing.

Having thus described our invention, we do not wish to be understood as limiting ourselves to the exact details of construction shown but instead wish to cover those modifications thereof that will occur to those skilled in the art after learning of our invention, and that properly fall within the scope of our invention.

We claim:

1. Forced hot air circulation means to be installed in a room having a convention fireplace of the type having a firebox, having a hearth extending from inside the firebox to an outside hearth area in front of and wider than said firebox to extend to each side of said firebox, and having facings above and to the sides of said firebox, comprising:

a. a generally box-shaped sheet metal outer housing resting on said outside hearth area in front of said firebox and lapping at least the margins of said facings above said firebox and said facings to the sides of said firebox, b. said housing having sidewalls aligned with and disposed in vertical planes normal to said facings to the sides of said firebox, c. said housing having means supported between said sidewalls in the upper portion of said housing including a chamber located at least mostly outside of said firebox with air outlet means at its front to exhaust air into said room, d. said housing having means supported between said sidewalls in the lower portion of said housing including an air ingress manifold located at least mostly outside of said firebox, and at least one blower located outside of said firebox having an inlet for room air and exhausting into said air ingress manifold, e. said housing having an open central housing portion in front of said firebox and located between said chamber and said manifold and between said sidewalls and providing access to and viewing of said firebox, and f. spaced, juxtaposed tubular means connected to said housing and including first lower generally horizontally disposed tubular portions connected to said manifold at their forward ends to receive air therefrom and extending rearwardly into said firebox defining a grate, second air transferring means connecting to the rear ends of said first tubular portions and extending upwardly to the upper portion of said firebox, and third upper tubular portions connecting to the upper end of said second air transferring means and extending forwardly and connecting to the rear of said chamber for exhausting of air to said room, thereby delivering a flow of heated air when a fire burns in said firebox.

2. The subject matter of claim 1 in which said open central housing portion extends substantially at least from one side of said firebox to the other so that the fire can be seen from viewpoints in said room in an arc horizontally generally comparable to viewing of a conventional fireplace and in which said open central housing portion extends at least about half of the vertical height of said firebox from a level near to said grate upwardly so that the fire can be seen in said room from viewpoints in an arc vertically in most sitting positions and in most standing positions except those close to the fireplace.

3. The subject matter of claim 1 in which said housing and said tubular means can be installed by merely pushing said tubular means into said firebox and by pushing said housing into abutment with said facings of said fireplace.

4. The subject matter of claim 1 in which there is leg means supporting the rear end of said first tubular portions on said hearth in said firebox and in which there is a removable ash tray below said grate and having a front wall disposed in the bottom, central portion of said housing.

5. The subject matter of claim 1 in which said first lower tubular portions and said second air transferring means are formed by a series of juxtaposed tubes extending rearwardly horizontally from said air ingress manifold to form said grate and then extending upwardly, a second manifold connecting the upper ends of said tubes, and said third upper tubular portions being formed by a bank of smaller tubes than said juxtaposed tubes, said smaller tubes being more numerous than said juxtaposed tubes and being arranged in a plurality of rows disposed so that when viewed from above said bank forms a substantially continuous heat exchanging medium, so that gas rising from a fire on said grate will follow tortuous paths in passing through said bank of tubes, said smaller tubes being connected at their rear ends to said second manifold and being connected at their forward ends to said chamber.

6. The subject matter of claim 1 in which there are a pair of blowers connected to said air ingress manifold, each blower being located in said housing and between said sidewalls and said blowers being disposed on opposite sides of said air ingress manifold, said blowers having central inlets and there being face plates supported by said housing covering the fronts of said blowers and spaced therefrom to permit air access to said central inlets, and a draw fireplace screen having its upper edge supported by said housing and disposed to form a spark arresting medium including covering of said open central housing portion when drawn.

7. Forced hot air circulation means to be installed in a room having a conventional fireplace of the type having a firebox, having a hearth extending from inside the firebox to an outside hearth area in front of and wider than said firebox to extend to each side of said firebox, and having facings above and to the sides of said firebox, comprising:

a. a sheet metal outer housing of substantial depth resting on said outside hearth area in front of said firebox and at least mostly outside of said firebox, and at least meeting the margins of said facings above said firebox and said facings to the sides of said firebox, said housing being self-supporting without attachment to said fireplace and being installed by sliding into place, b. said housing having outside of said firebox an upper wall extending from side to side of said housing and sidewalls extending from top to bottom of said housing and air outlet means located under said upper wall and between said sidewalls in the upper portion of said housing to exhaust air into said room, c. said housing having means supported between said sidewalls in the lower portion of said housing including an air ingress manifold, and at least one blower located outside of said firebox having an inlet for room air and exhausting into said air ingress manifold, d. said housing having an open central housing portion in front of said firebox and located between said air outlet means and said manifold and between said sidewalls and providing access to and viewing of said firebox, and e. spaced, juxtaposed tubular means connected to said housing and including first lower generally horizontally disposed tubular portions connected to said manifold at their forward ends to receive air therefrom and extending rearwardly into said firebox defining a grate, send air transferring means connecting to the rear ends of said first tubular portions and extending upwardly to the upper portion of said firebox, and third upper tubular portions connecting to the upper end of said second air transferring means and extending forwardly and connecting to said air outlet means for exhausting of air to said room, thereby delivering a flow of heated air when a fire burns in said firebox.

* * * * *